US010486930B2

(12) United States Patent
Muller

(10) Patent No.: US 10,486,930 B2
(45) Date of Patent: Nov. 26, 2019

(54) METHOD FOR CUTTING AND CONNECTING TWO BANDS END TO END, AN UNROLLING MACHINE AND A CUTTING AND CONNECTING DEVICE

(71) Applicant: MONOMATIC, Strasbourg (FR)

(72) Inventor: Bernard Muller, Drusenheim (FR)

(73) Assignee: MONOMATIC, Strasbourg (FR)

( * ) Notice: Subject to any disclaimer, the term of this patent is extended or adjusted under 35 U.S.C. 154(b) by 275 days.

(21) Appl. No.: 15/603,825

(22) Filed: May 24, 2017

(65) Prior Publication Data

US 2017/0341894 A1 Nov. 30, 2017

(30) Foreign Application Priority Data

May 24, 2016 (FR) ..... 16 54645

(51) Int. Cl.

| | |
|---|---|
| ***B65H 19/18*** | (2006.01) |
| ***B65H 19/20*** | (2006.01) |
| ***B65H 19/14*** | (2006.01) |
| ***B65H 19/10*** | (2006.01) |

(52) U.S. Cl.

CPC ..... *B65H 19/1852* (2013.01); *B65H 19/102* (2013.01); *B65H 19/107* (2013.01); *B65H 19/14* (2013.01); *B65H 19/1873* (2013.01); *B65H 19/20* (2013.01); *B65H 2301/4622* (2013.01); *B65H 2301/4625* (2013.01); *B65H 2301/4641* (2013.01); *B65H 2301/46176* (2013.01); *B65H 2301/46178* (2013.01); *B65H 2301/46222* (2013.01); *B65H 2301/46314* (2013.01); *B65H 2801/21* (2013.01)

(58) Field of Classification Search

CPC .... B65H 19/102; B65H 19/107; B65H 19/14; B65H 19/1852; B65H 19/1873; B65H 19/20

See application file for complete search history.

(56) References Cited

FOREIGN PATENT DOCUMENTS

| | | | | |
|---|---|---|---|---|
| FR | 2332115 A1 | | 6/1977 | |
| FR | 2679541 A1 | | 1/1993 | |
| FR | 2750968 A1 | * | 1/1998 | ..... B65H 19/1852 |
| FR | 2930534 A1 | | 10/2009 | |

OTHER PUBLICATIONS

Machine Translation of FR 2 750 968 A1, Jan. 16, 1998. (Year: 1998).*

Search Report for corresponding French Application No. 1654645 dated Feb. 21, 2017.

* cited by examiner

*Primary Examiner* — William E Dondero

(74) *Attorney, Agent, or Firm* — Carter, DeLuca & Farrell LLP

(57) ABSTRACT

A method for cutting and connecting two bands end to end and which are at a stop, namely a first band ensuring the feed, and a second replacement band, in an unrolling machine including a cutting and connecting device including two connection assemblies arranged symmetrically with respect to a cutting and connection plane is provided. Utilizing the unrolling machine the method includes preparation of the second band, then immobilization of the bands in the plane, of simultaneous and transverse cutting of the latter, of disengagement of the cut portions not to be connected, and of end-to-end connecting of the cut portions thereof to be connected. A cutting and connecting device and a machine enabling the implementation of the method is also provided.

18 Claims, 8 Drawing Sheets

METHOD FOR CUTTING AND CONNECTING TWO BANDS END TO END, AN UNROLLING MACHINE AND A CUTTING AND CONNECTING DEVICE

CROSS REFERENCE TO RELATED APPLICATIONS

This application claims the benefit and priority from French Patent Application No. 1654645, filed May 24, 2016, the disclosure of which is hereby incorporated by reference herein in its entirety.

TECHNICAL FIELD

The present invention concerns the field of machines for unrolling materials in band form from spools, in order to feed unrolling machines, in particular processing machines such as printing machines, cutting machines or folding-gluing machines, and it relates to a method for cutting and connecting two bands end to end and which are at a stop in an unrolling machine, and to a cutting and connecting device making it possible to carry out said method. It also relates to an unrolling machine provided with such a device.

BACKGROUND

An unrolling machine generally includes two spool carrier elements each supporting a spool for a finishing band, that is to say a band feeding a processing machine located downstream, and a spool for a new band intended to be connected end to end to the finishing band at the end of the unrolling of the latter to ensure the continuity of the band feed downstream of the machine.

In the known unrolling machines, the connection of the finishing band to the start of the new band is generally carried out during a temporary stop of the unrolling machine, the finishing band running, so as to ensure the continuity of the unrolling during this temporary period, into a band reserve arranged between the outlet of the unrolling machine and the processing machine located downstream.

Among the known unrolling machines, an unrolling machine is disclosed in the document FR-A-2618769, which consists essentially of two spool carrier towers, the upper portion of which is covered by a bridge structure for accommodation of a band accumulator, and of two assemblies for connection of bands which are at a stop, also known under the name of connection boxes or connection semi-cassettes, each dedicated to a spool carrier tower, that is to say to an unrolling or replacement band rolled on the spool mounted on such a spool carrier tower, and which are mounted so that they are mobile in translation, transversely to the band under the bridge structure.

The connection assemblies are mounted in opposition, each under the bridge structure, in such a manner that they can be moved transversely with respect to the latter, by means of horizontal slide firmly attached to said structure and protruding forward with respect to the latter, and they are firmly attached in translation each to the corresponding tower, in order to be able to follow all the movements of the corresponding tower.

On the surface facing the opposite connection assembly, each connection assembly has a plate provided, on the one hand, with a transverse slot inclined with respect to the horizontal, in which is mounted, movable by means of a jack or a linear motor, a cutting device, and, on the other hand, with several rows of air aspiration holes, or grippers, these holes or grippers being arranged, on the one hand, on both sides of the slot, and, on the other hand, parallel to the lower edge of the plate, which is moreover mounted along one of the horizontal edges thereof, preferably along the lower edge thereof, in a pivoting matter on the box, the pivot shaft of the plate simultaneously forming the support of deflection cylinders of the band to be unrolled.

The connection assemblies have a width that is greater than the largest possible width of the bands to be unrolled, and the plates thereof are, on the one hand, symmetrical with respect to a vertical plane passing between the boxes, and, on the other hand, loaded each on the internal surface thereof by a device for pivoting around the shaft.

A simultaneous actuation of the movement device for each plate has the effect of causing a pivoting of said plates around the shaft thereof and of bringing about a tight application of the central planes containing the transverse slots of said plates with interposition of the finishing band and the new band, as well as of their end to end linking adhesive joint.

This unrolling machine makes it possible to perform a cutting and a precise connection between finishing band and new band with great precision with a brief interruption of the unrolling device, requiring a downstream accumulation.

However, these known unrolling machines do not fully meet the new production requirements which impose greater speeds with a guarantee of perfect connection.

The document FR 2 930 534 proposes a device for cutting and end to end gluing, which makes it possible to ensure reduction of the connection time while at the same time guaranteeing a perfect connection. Such a device is provided for an unrolling machine comprising two spools and consisting essentially of two spool carrier elements supporting said spools and covered on their upper portion by a bridge structure capable of accommodating a band accumulator, and of two assemblies for connection of bands which are at a stop, each assigned to a spool carrier element and arranged symmetrically with respect to the unrolling axis of the bands or to the plane containing said axis. In such a device, each connection assembly, also known under the name of connection box or connection semi-cassette, comprises a station for the preparation and transfer of a joint, a device for holding and cutting the new band or the finishing band, and optionally a means for moving the band connection assemblies closer or father apart.

However, in a machine of the type of the document FR 2 930 534, the device for the preparation and transfer of a joint is complex, and the machine requires a transfer system in order to be able to gain access behind the advancing band. In addition, a machine of this type requires moving the two connection assemblies farther apart from or closer to one another, by translation or rotation, in order to carry out the preparation step, so as to create a sufficiently large area of passage between said assemblies and/or around the latter in order to enable the passage of an operator so that the latter can perform the preparation. The result of this moving closer or apart is the need to provide a large-amplitude area of clearance which is reflected in a large space requirement of the machine.

The document FR 2 332 115 concerns an apparatus for end to end assembling of two bands in order to put a new band at the end of a finishing band, and of which the band ends to be connected by a tape are located in the same plane and separated by a short distance. It includes squeezing means including a squeezing piece comprising a control bar for controlling the end to end position, and cutting and assembly means mounted on carriages that can be moved along an elongate bar. It also includes an accumulation device for temporarily stopping the band during the connection period.

However, an apparatus of the type disclosed by the document FR 2 332 115 or the method used by such an apparatus requires the use of a device for positioning the spools so that the new band is always on the same side of the unrolling band. In addition, this type of apparatus requires a second cutting in order to cut a thin band at the end of the new band and remove it to leave room for the adhesive for the end to end connection. On the other hand, in this type of apparatus, the connection is carried out with a single adhesive or joint, that is to say only with a single piece of adhesive tape, applied to one of the sides or surfaces of the connected bands, which does not enable an effective and solid connection for a thick material, because, in passing over a roller for guiding or driving the band, the adhesive may deteriorate or be torn off.

The aim of the present invention is to overcome at least one of these disadvantages by proposing a method for cutting and connecting two bands end to end and which are at a stop in an unrolling machine, a device for cutting and connecting two bands end to end and which are at a stop for an unrolling machine, making it possible to carry out said method, and an unrolling machine provided with such a device, notably making it possible to obtain a simpler preparation and a reduced space requirement for the device or for the machine which guaranteeing that the connection is maintained intact.

SUMMARY

To this effect, the method for cutting and connecting two bands end to end and which are at a stop in an unrolling machine including a cutting and connecting device and two spool carrier elements, one of the spool carrier elements supporting a spool capable of unrolling a first band ensuring the feeding of the band to the machine and the other spool carrier element supporting a spool capable of unrolling a second band forming a replacement band, each band having two opposite longitudinal edges and two opposite sides, said cutting and connecting device including two connection assembles arranged symmetrically with respect to a cutting and connection plane and being capable of simultaneously and transversely cutting the two bands in said plane in a cutting direction and along a cutting line successively passing through the two longitudinal edges of each band, perpendicularly or at an angle with respect to the latter, each connection assembly including a mobile application support, method which is characterized in that it consists in carrying out, by means of said cutting and connecting device and said machine to which the band is fed by said spools, the following steps according to the two phases A/ and B/:

A/ during the unrolling of the first band:

a/ engaging the second band between the connection assemblies in order to place it and maintain it in a preparation position in which said second band extends on both sides upstream and downstream of the cutting line, b/ placing, outside of the connection assemblies, a piece of adhesive tape or the like on at least one of the application supports shifted to the outside for this purpose, c/ immobilizing the second band in the cutting and connection plane, B/ with the stopping of the unrolling of the first band at least in the downstream portion thereof:

if applicable, carrying out step b/ and/or step c/ in the case in which they are not carried out in phase A/, d/ immobilizing the first band in the connection plane, e/ simultaneously and transversely cutting the two bands in the cutting direction and along the cutting line, which has the effect of separating each band into two band portions, namely, on the one hand, a cut downstream band portion located downstream of the cutting line, and, on the other hand, a cut upstream band portion located upstream of the cutting line and connected to the spool of said band, f/ maintaining the immobilization, in the cutting and connection plane, of the cut upstream band portion of the second band and of the cut downstream band portion of the first band, g/ disengaging, by displacement or rolling of the band, the downstream band portion of the second band and the upstream band portion of the first band in order to free the connection zone including the end of the downstream band portion of the first band and the end of the upstream band portion of the second band to be connected together, h/ transferring, in the connection zone, the piece or the two pieces of adhesive tape, simultaneously or successively, by applying it to one of the sides, or by applying them each on one side, of the respective ends of the cut upstream and downstream band portions to be connected in order to carry out the connection of the two bands together using the one or the two piece(s) of adhesive tape, in order to form a new feed band.

The device for cutting and connecting two bands end to end and which are at a stop, according to the present invention, for an unrolling machine, making it possible to carry out the method of the invention, said machine including said cutting and connecting device and two spool carrier elements each capable of supporting a spool capable of unrolling a first band ensuring the feeding of the band to the machine or a second band forming a replacement band, said cutting and connecting device including two connection assemblies arranged symmetrically with respect to a cutting and connection plane, and the two spool carrier elements being arranged on both sides of said plane, is characterized essentially in that it includes a system for transverse cutting including a cutting device and displacement means capable of moving said cutting device in the cutting and connection plane in a transverse cutting direction and along a transverse cutting line, substantially perpendicular or at an angle with respect to the longitudinal edges, having the effect of simultaneously cutting the two bands, which are held in the immobilized state in said plane, by passing successively through the two respective longitudinal edges thereof, and in that each connection element, dedicated to either of said bands, comprises an adhesive application system including an application support capable of holding a piece of adhesive tape or the like and displacement means for the application capable of moving the corresponding application support from a waiting position located in the corresponding connection assembly into an application position, of said piece of adhesive tape, located in the cutting and connection plane, and vice versa, a first immobilization system capable of immobilizing the first band in said cutting and connection plane, and a second immobilization system capable of holding the second band in a preparation position and immobilizing the latter in the cutting and connection plane, and a disengagement system making it possible to disengage, after the cutting, by displacement or rolling up of band, the cut band portions not intended to be connected in order to enable, as desired, the application of one or two pieces of adhesive tape by means of the displacement of the two opposite application supports.

The unrolling machine, according to the present invention, including a cutting and connecting device and two spool carrier elements each capable of supporting a spool capable of unrolling a first band ensuring the feeding of the band to the machine or a spool capable of unrolling a second band forming a replacement band, is characterized in that said cutting and connecting device consists of a cutting and connecting device according to the present invention, and, preferably, in that it includes a band accumulator located downstream of the cutting and connecting device and which is capable of being filled with a given length of first band, before the stopping and the immobilization of the latter in the cutting and connecting device, and of ensuring the continuity of the downstream feed during the connection and the immobilization of the first band in said device.

BRIEF DESCRIPTION OF THE DRAWINGS

The invention will be understood better thanks to following description which refers to a preferred embodiment given as a non-limiting example and explained in reference to the appended diagrammatic drawings, in which.

DETAILED DESCRIPTION

The figures show the implementation of the method for cutting and connecting two bands end to end and which are at a stop in an unrolling machine including a cutting and connecting device, according to the present invention, and two spool carrier elements.

According to the present invention, one of the spool carrier elements supports a spool 3*a* capable of unrolling a first band 2*a* ensuring the feeding of the band to the machine and the other spool carrier element supporting a spool 3*b* capable of unrolling a second band 2*b* forming a replacement band, each band 2*a*, 2*b* having two opposite longitudinal edges and two opposite sides.

Still according to the invention, the cutting and connecting device includes two connection assemblies 1*a*, 1*b* arranged symmetrically with respect to a cutting and connection plane P, and is capable of simultaneously and transversely cutting the two bands 2*a*, 2*b* in said plane in a cutting direction and along a cutting line passing successively through the two longitudinal edges of each band, perpendicularly or at an angle with respect to the latter. In addition, each connection assembly includes a mobile application support 50*a*, 50*b*.

The two spool carrier elements, namely a first spool carrier and a second spool carrier, can be arranged, as is the case in the appended figures, on both sides of the cutting and connection plane P, or, in a variant not represented in the appended figures, on the same side but with deflection rollers located on both sides of the latter.

Figure 1:
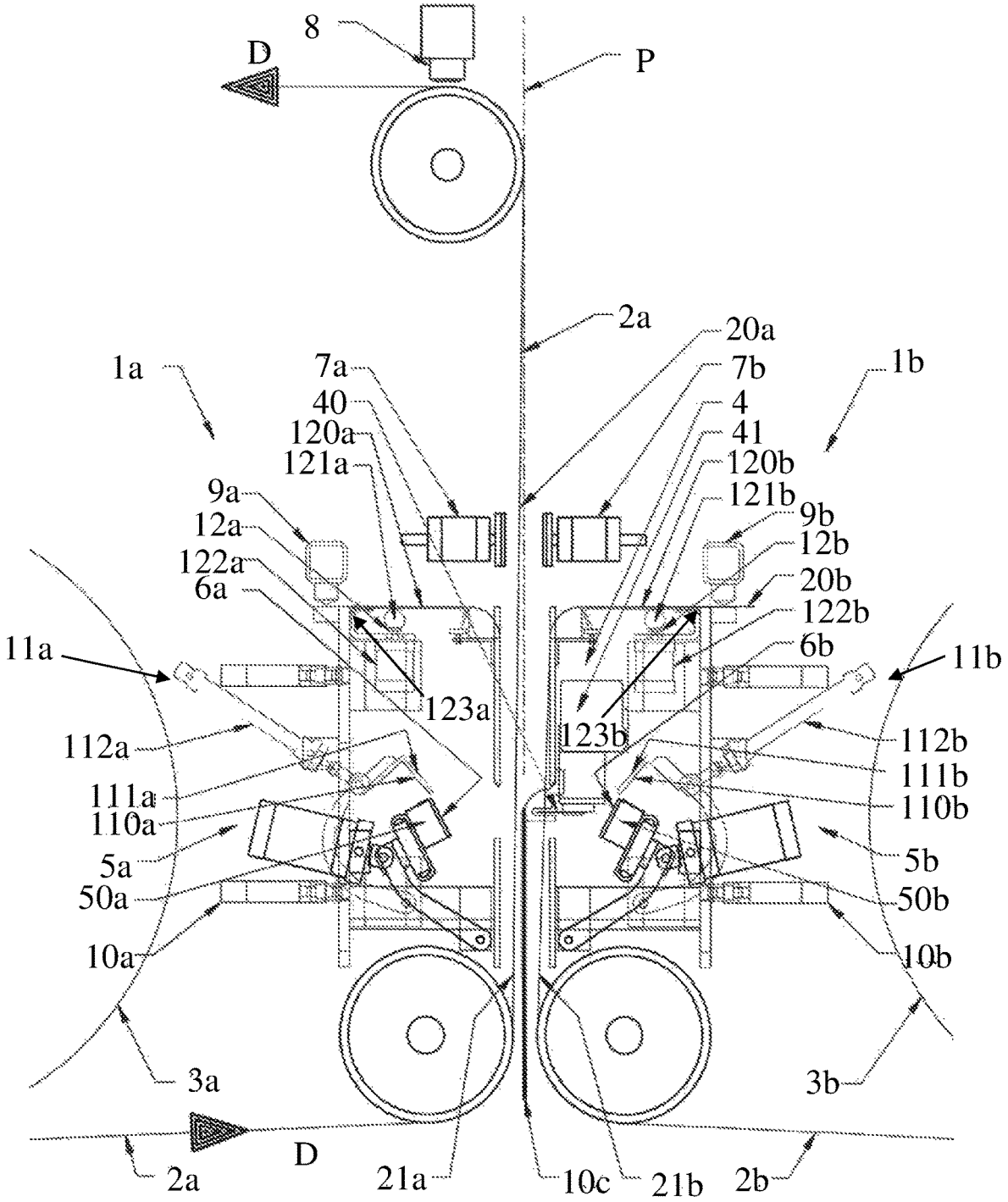
FIG. 1 shows a longitudinal section of the cutting and connecting device mounted in an unrolling machine, according to the present invention, in a vertical orientation, in the step of unrolling the first band forming the unrolling and finishing band and of placing in waiting mode of the second band forming the new replacement band to be connected to said first band, in the preparation position of said second band, each connection assembly being provided with a band curvature straightening system.
Figure 2:
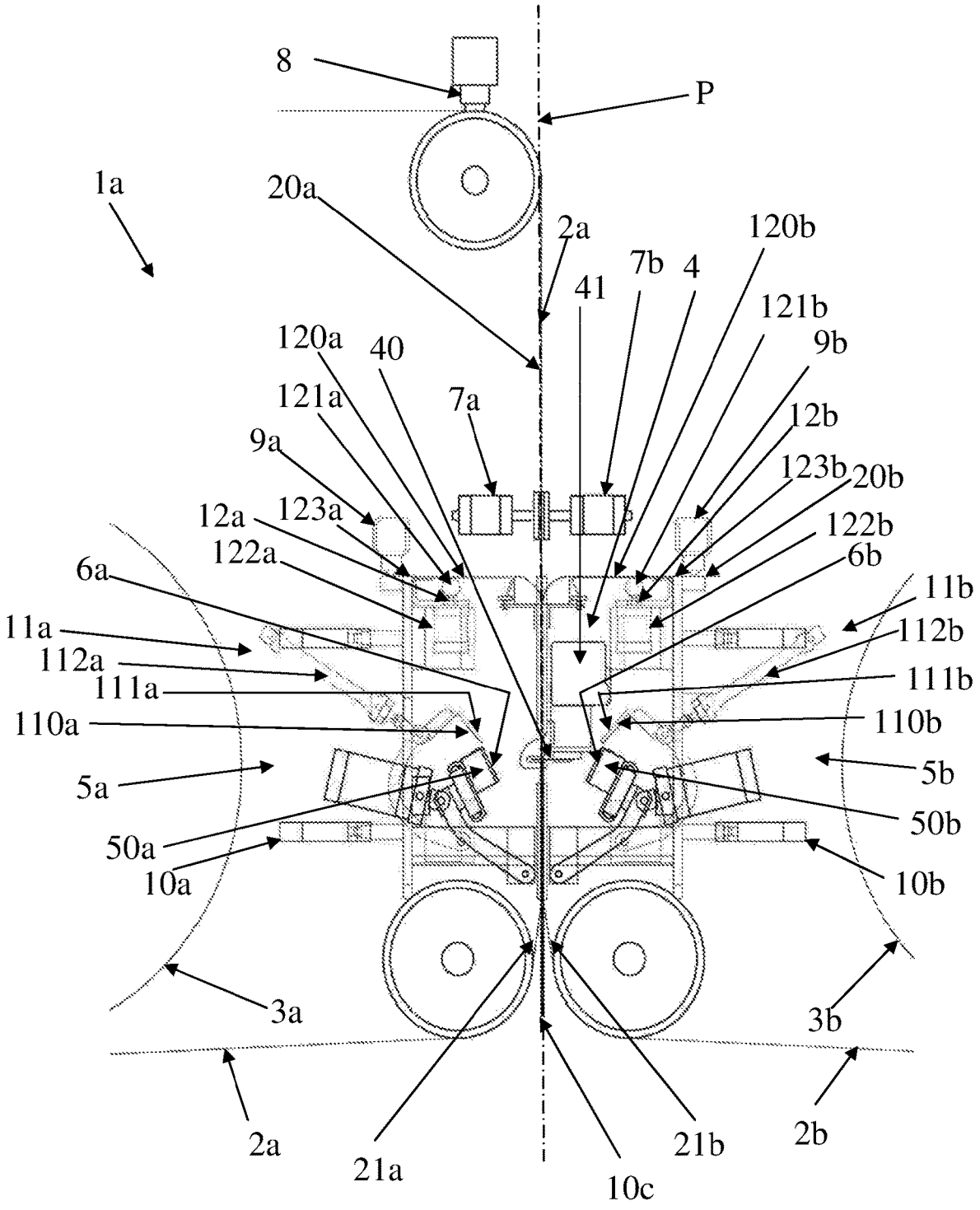
FIG. 2 shows the cutting and connecting device represented in FIG. 1, in the step of immobilization of the first band and of the second band in the cutting and connection plane, and in the step of the transverse cutting of said bands.
Figure 3:
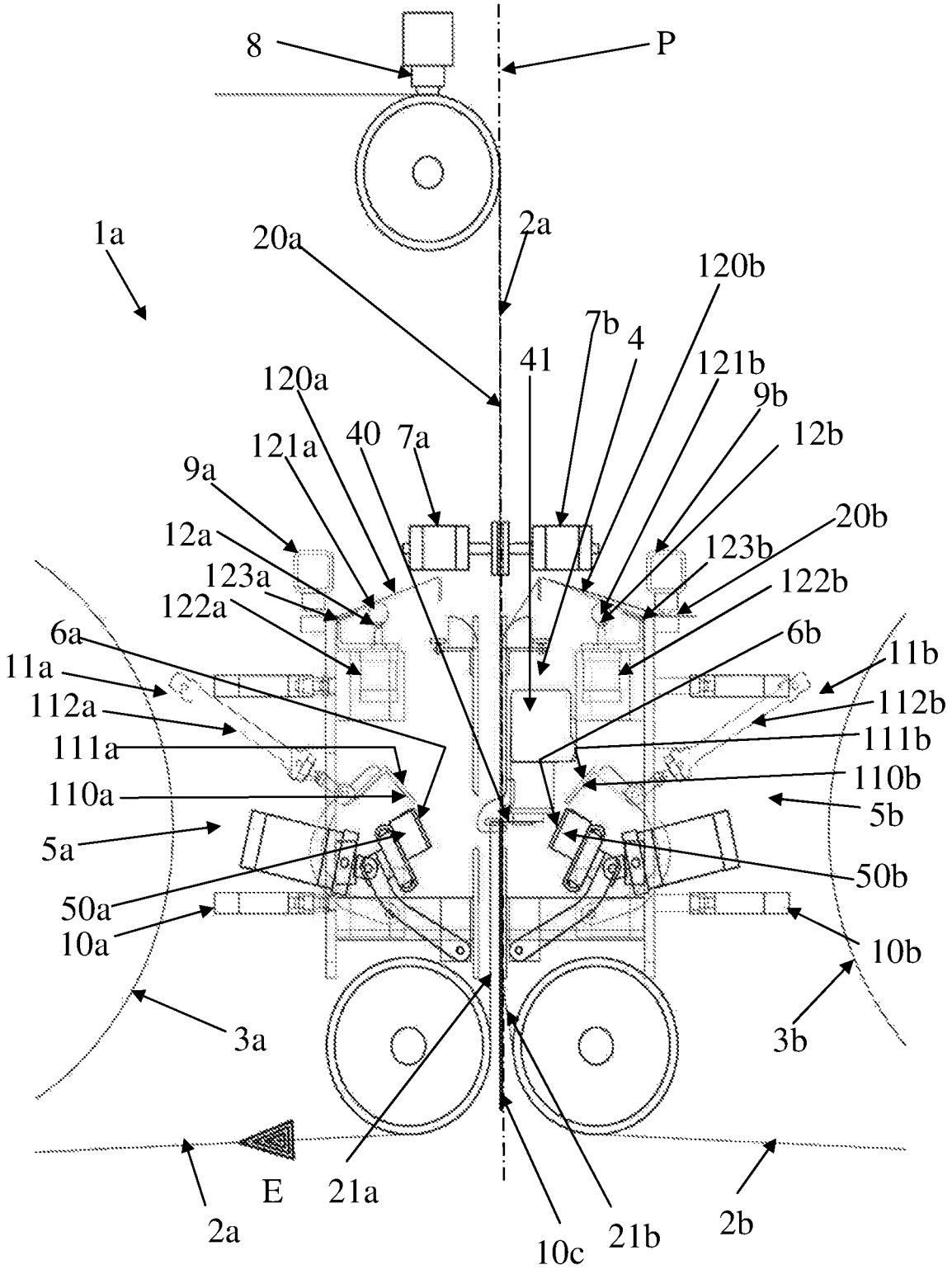
FIG. 3 shows the cutting and connecting device represented in FIG. 1, in the step of immobilization of the portion of the cut downstream band portion of the first band, and of immobilization of the cut upstream band portion of the second band to be connected together end to end, and, in the step of disengagement, by lifting, of the cut downstream band portion of the second band and disengagement of the upstream band portion of the first band by rolling the latter around the spool thereof.
Figure 4:
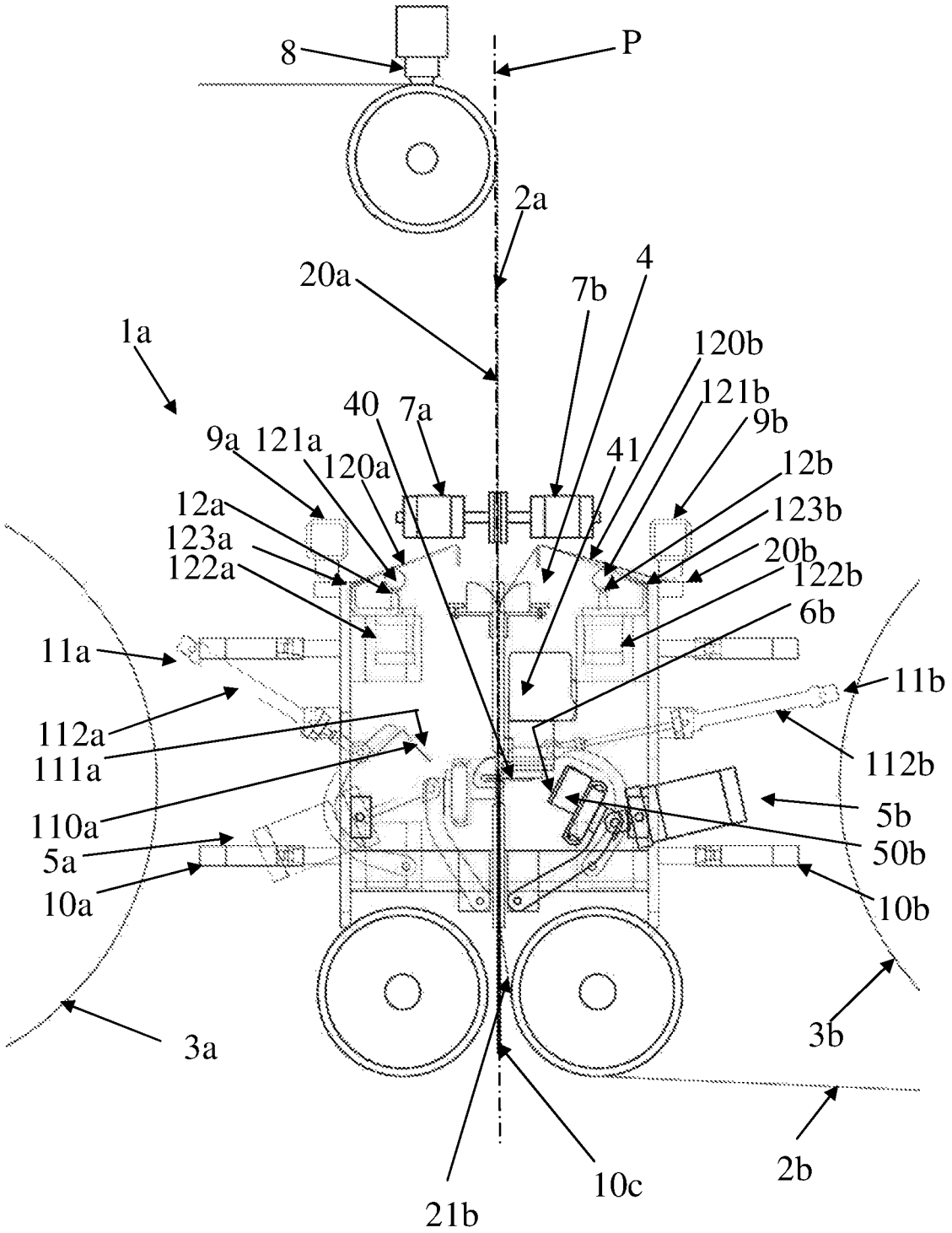
FIG. 4 shows the cutting and connecting device represented in FIG. 1, in the step of straightening of the bent curvature of the first band.
Figure 5:
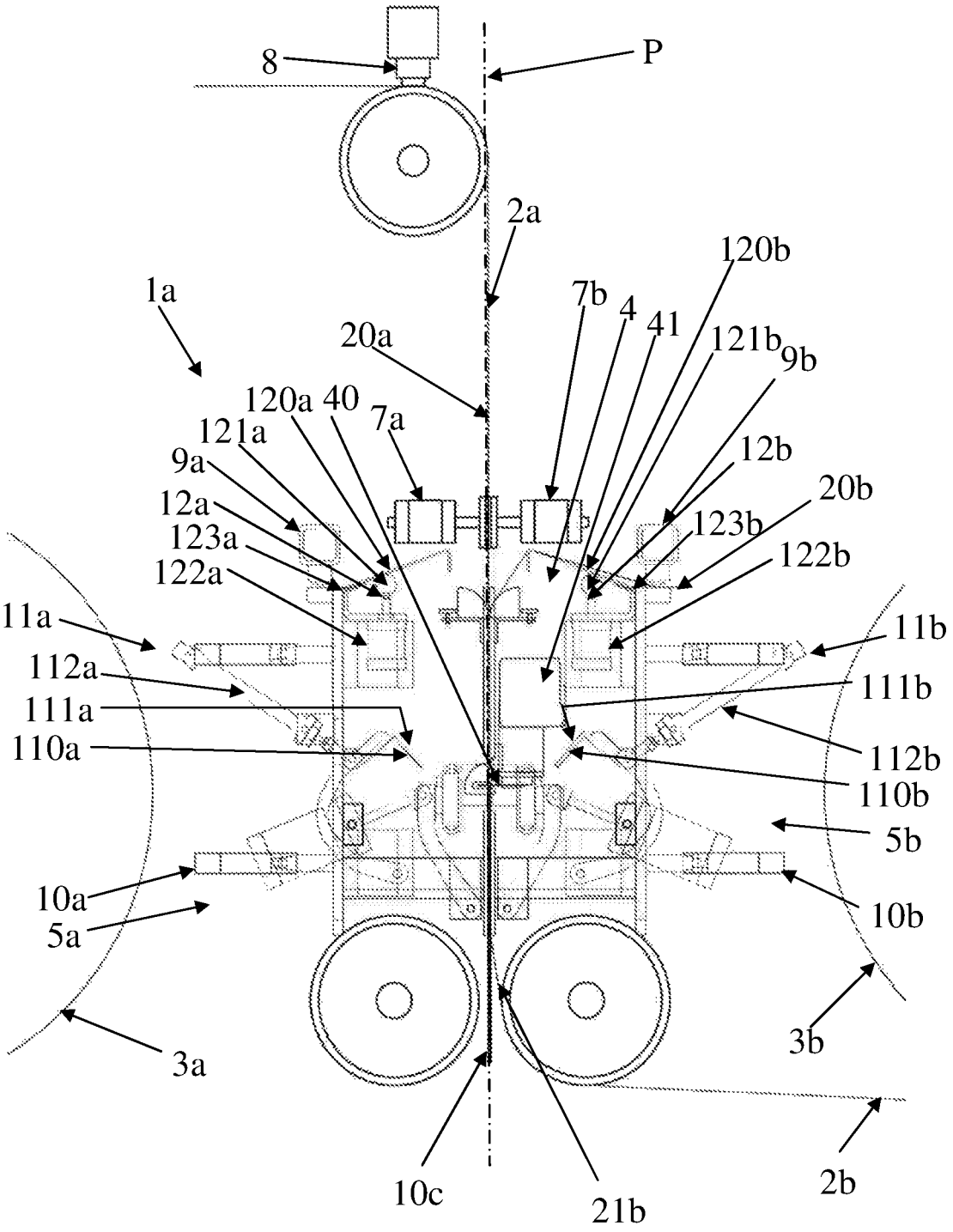
FIG. 5 shows the cutting and connecting device represented in FIG. 1, in the step of connection with the pieces of adhesive tape or the like which are each applied and fastened, extending on both sides of the cutting line, on one of the opposite sides of the two upstream and downstream band portions, respectively, of the first and second bands which are immobilized in the connection plane.
Figure 6:
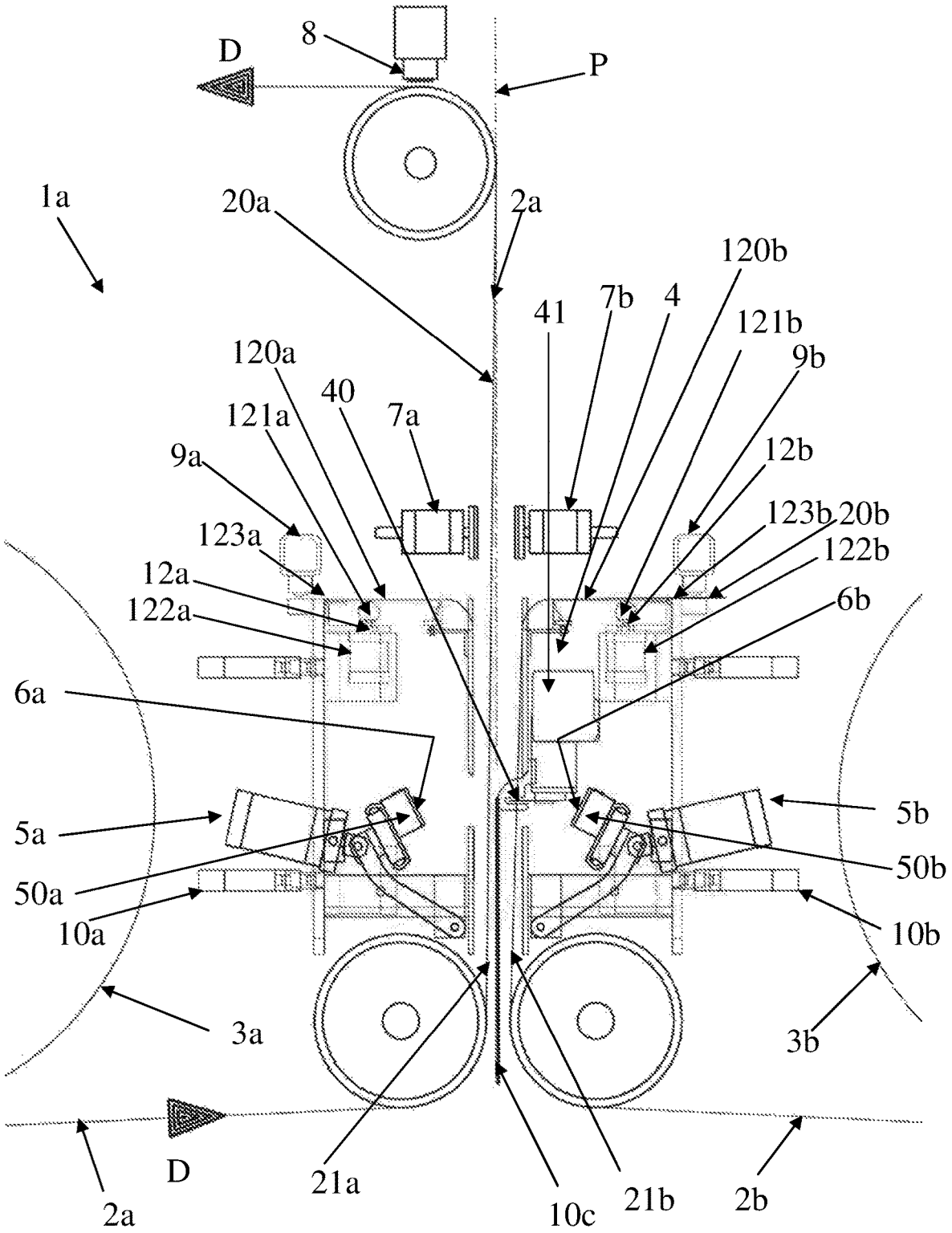
FIG. 6 shows the cutting and connecting device represented in FIG. 1 in an embodiment without band curvature straightening system.

Still according to the invention, the method consists in carrying out, by means of said cutting and connecting device and said machine fed with band by said spools, the following steps according to the two phases A/ and B/:

A/ during the unrolling of the first band 2*a* a/ engaging the second band 2*b* between the connection assemblies 1*a* and 1*b* in order to place it and hold it in a preparation position in which said second band extends on both sides upstream and downstream of the cutting line (FIG. 1), b/ placing, outside of the connection assemblies, a piece of adhesive tape or the like on at least one of the application supports 50*a* and 50*b* shifted to the outside for this purpose, c/ immobilizing the second band in the cutting and connection plane P, B/ with the stopping of the unrolling of the first band 2*a* at least in the downstream portion thereof:

if applicable, carrying out step b/ and/or step c/ in the case in which they are not carried out in phase A/, d/ immobilizing the first band 2*a* in the connection plane P (FIG. 2), e/ simultaneously and transversely cutting the two bands 2*a* and 2*b* in the cutting direction and along the cutting line, which has the effect of separating each band into two band portions, namely, on the one hand, a cut downstream band portion 20*a* or 20*b* located downstream of the cutting line, and, on the other hand, a cut upstream band portion 21*a* or 21*b* located upstream of the cutting line and connected to the spool 3*a* or 3*b* of said band (FIG. 2), f/ maintaining the immobilization, in the cutting and connection plane, of the cut upstream band portion 21*b* of the second band 2*b* and of the cut downstream band portion 20*a* of the first band 2*a* (FIG. 3), g/ disengaging, by displacement or rolling of the band, the downstream band portion 20*b* of the second band 2*b* and the upstream band portion 21*a* of the first band 2*a* in order to free the connection zone including the end of the downstream band portion of the first band 2*a* and the end of the upstream band portion of the second band 2*b* to be connected together (FIG. 3), h/ transferring, in the connection zone: the two pieces of adhesive tape 6*a* and 6*b*, simultaneously or successively, by applying it to one of the sides, or by applying them each on one side, of the respective ends of the cut upstream and downstream band portions 20*a* and 21*b* to be connected, that is to say on at least one of the opposite sides of the free ends of said portions, in order to carry out the connection of the two bands together using the one or the two piece(s) of adhesive tape 6*a* and/or 6*b*, in order to form a new feed band (FIG. 4 and FIG. 5).

It should be understood that, due to symmetry, at the end of the connection process illustrated in the appended figures, wherein the spool 3*a* capable of unrolling the first band 2*a* in order to ensure the feeding of the machine is supported by the first spool carrier (not represented) located on one side of the cutting and connection plane P (to the left of said plane), and wherein the spool 3*b* capable of unrolling the second band 2*b* forming the replacement band is supported by the second spool carried located on the other side of said plane (to the right of the latter), in a succeeding connection process, the spool 3*a* capable of unrolling the first band 2*a* in order to ensure the feeding of the band to the machine will be supported by the second spool carrier, and conversely the spool 3*b* capable of unrolling the second band 2*b* forming the replacement band will be supported by the first spool carrier.

In addition, it should be noted that in step e/, the inclination of the cutting line with respect to the longitudinal edges of the bands 2*a*, 2*b* to be cut can be set as a function of the material of said bands. For example, with a material such as paper, a substantially perpendicular inclination can preferably be set, and, with a material such as cardboard, an inclination of varying extent can be implemented. More particularly, it has been observed, in tests performed by the present applicant, that the thicker the material is, the greater the inclination with respect to said bands should be in order to obtain the most effective cutting possible, both in terms of both cutting speed and cutting quality.

In a preferred embodiment of step h/, the or each piece of adhesive tape 6*a* or 6*b* can be transferred in the connection zone in a single translation or rotation movement from a waiting position located in the corresponding connection assembly to a connection position located in the connection zone in the cutting and connection plane P (FIGS. 4 and 5).

Preferably, as one can see in FIGS. 4 and 5, in step g/, the disengagement of the cut downstream band portion 20*b* of the second band 2*b* can be carried out by a downstream movement (FIGS. 4 and 5) or lateral movement (not represented) of said cut downstream band portion 20*b*.

In step g/, the disengagement of the cut upstream band portion 21*a* of the first band 2*a* can be brought about by a rolling (represented by E in FIG. 3) of the latter around the spool 3*a* (FIG. 3) thereof and/or, in a form that is not represented, by gravity and/or by blowing and/or by any other suitable disengagement means. In the case of a disengagement by gravity, notably in a vertical position of the device according to the present invention, the cut upstream band portion 21*a* will become disengaged by moving naturally, after the cutting, due to its own weight, falling due to the effect of gravity (weight force component). The rolling of the upstream band portion 21*a* in order to bring about the disengagement thus enables a complete disengagement of the cut band portion 21*a* of the first band 2*a* outside of the cutting and connecting device.

In a particular embodiment, in reference to FIG. 4, one can see that, using a cutting and connecting device, according to the present invention, each connection assembly 1*a* or 1*b* of which can include, in addition, as we shall see below, a band curvature straightening system 11*a* or 11*b* comprising a straightening contact element 110*a* or 110*b* (FIGS. 1, 2, 3, 4, 5, 7), in step h/ and in the case in which the first band 2*a* and/or the second band 2*b* is/are curved with the opposite sides thereof having a convex curvature, the method can consist in successively transferring, in the connection zone, the two pieces of adhesive tape 6*a* and 6*b*, namely, in a first step, according to the orientation of the convexity of the curvature, the piece of adhesive tape 6*a* or 6*b* supported by the application support 50*a* or 50*b* located on the side of the convex curvature, and in straightening the curvature of the first band 2*a* and/or of the second band 2*b*, to make the latter as flat as possible by coming in contact with pressure with the other opposite side of the cut band portions 20*a* and 21*b* to be connected of the first and second bands 2*a* and 2*b*, by means of the other opposite straightening contact element 110*a* or 110*b*, and then, optionally, in a second step, the other piece of adhesive tape 6*a* or 6*b* in order to finalize the connection.

As we already mentioned in part in the description of the method above, the appended figures show that the cutting and connecting device, according to the present invention, of two bands end to end and which are at a stop, for an unrolling machine, and enabling the implementation of the method according to the present invention, said machine, including said cutting and connecting device and two spool carrier elements each capable of supporting a spool 3*a* or 3*b* capable of unrolling a first band 2*a* ensuring the feeding of the band to the machine or a second band 2*b* forming a replacement band, includes two connection assemblies 1*a* and 1*b* arranged symmetrically with respect to the cutting and connection plane P.

According to the present invention, such a cutting and connecting device includes a transverse cutting system 4 including a cutting device 40 and displacement means 41 capable of moving said cutting device in the cutting and connection plane P in a transverse cutting direction and along a transverse cutting line, substantially perpendicular or at an angle with respect to the longitudinal edges, having the effect of simultaneously cutting the two bands 2*a* and 2*b*, held in the immobile state in said plane, by successively passing through the two respective longitudinal edges thereof.

Still according to the present invention, each connection element 1*a* or 1*b*, dedicated to either of said bands 2*a* or 2*b*, includes:

an adhesive application system 5*a* or 5*b* including an application support 50*a* or 50*b* capable of holding a piece of adhesive tape 6*a* or 6*b* or the like and corresponding displacement means capable of moving the application support 50*a* or 50*b* from a waiting position located in the corresponding connection assembly to an application position, of the piece of adhesive tape 6*a* or 6*b*, located in the cutting and connection plane P, and vice versa, a first immobilization system 7*a* or 7*b*, 8, 10*a* or 10*b*, 10*c* capable of immobilizing the first band 2*a* in the cutting and connection plane, a second immobilization system 9*a* or 9*b*, 10*a* or 10*b*, 10*c* capable of holding the second band 2*b* in a preparation position and immobilizing the latter in the cutting and connection plane P, a disengagement system 3*a*, 12*a* or 12*b* making it possible to disengage, after the cutting, by displacement or rolling of the band, the cut band portions 21*a* and 21*b* not intended to be connected, in order to enable, as the operator wishes, the application of one or two pieces of adhesive tape thanks to the movement of one or of the two opposite application supports 50*a* and 50*b*.

In a preferred embodiment, the displacement means for the application 51*a*, 52*a*, 51*b*, 52*b* can be capable of moving the corresponding application support 50*a*, 50*b* in a single translation or rotation movement from the waiting position thereof toward the application position thereof.

Figure 7:
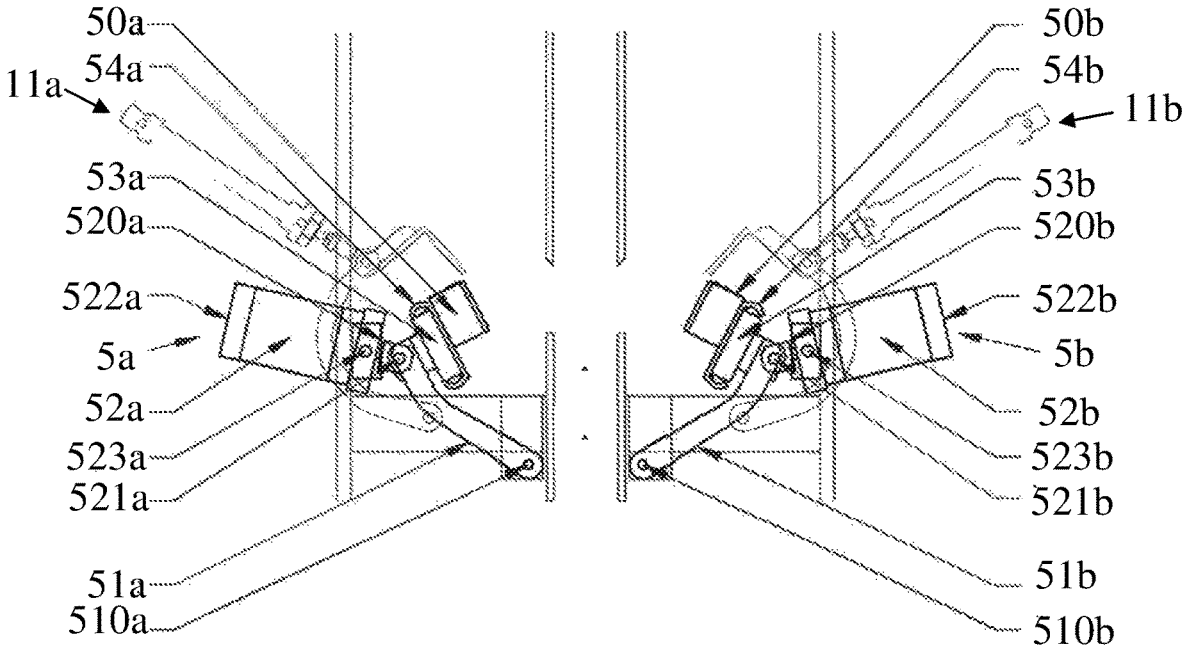
FIG. 7 shows the band curvature straightening system and of the adhesive application system of the cutting and connecting device represented in FIG. 1.

In the case in which the displacement means for the application 51*a*, 52*a*, 51*b*, 52*b* are capable of moving the corresponding application support 50*a*, 50*b* in a single rotation movement, said displacement means for the application can consist, as one can see in the figures and more particularly in FIG. 7, of a lever system which can include, on the one hand, a drive rod 51*a*, 51*b* to which the corresponding application support 50*a*, 50*b* can be fastened and which can be capable of pivoting around a first pivot 510*a*, 510*b* parallel to the cutting and connection plane P, and, on the other hand, an actuator 52*a*, 52*b* capable of acting on said rod to bring about the pivoting thereof. If applicable, said actuator can consist of a jack comprising a rod 520*a*, 520*b* hinged at its end on said drive rod around a second pivot 521*a*, 521*b*, while the body 522*a*, 522*b* of the jack can be pivotably mounted around a third pivot 523*a*, 523*b* parallel to said first and second pivots.

In the case in which the displacement means for the application 51*a*, 52*a*, 51*b*, 52*b* are capable of moving the corresponding application support 50*a*, 50*b* in a single translation movement, said displacement means for the application can consist, in a manner not represented in the figures, of an actuator, for example, of the hydraulic or pneumatic jack type.

It should be noted that, in the case in which the displacement means for the application 51*a*, 52*a*, 51*b*, 52*b* are capable of moving the corresponding application support 50*a*, 50*b* in a single rotation movement, this implementation requires less space or clearance to be implemented than when another displacement means is used, notably by translation, which makes it possible to put all the elements in a smaller and less congested space.

Each adhesive application system 5*a*, 5*b* can include, in addition, displacement means for the preparation 53*a*, 54*a* or 53*b*, 54*b* capable of moving the corresponding application support 50*a* or 50*b* from a preparation position located outside of the cutting and connecting device, that is to say, in particular, outside of the corresponding connection assembly 1*a* or 1*b*, and provided in order to accommodate, that is to say to receive manually or automatically by means of a gripping and positioning means not represented, a piece of adhesive tape 6*a* or 6*b*, to the waiting position located in the corresponding connection assembly 1*a*, 1*b*, and vice versa (all the figures and, in particular, FIG. 7).

The displacement means for the preparation 53*a*, 54*a* or 53*b*, 54*b* can be capable of moving the corresponding application support 50*a* or 50*b*, which can be, for example, in the form of a bar, in a translation movement parallel to the cutting and connection plane P. In addition, said displacement means for the preparation 53*a*, 54*a* or 53*b*, 54*b* can consist of a sliding system including as a slide 53*a* or 53*b* fastened to the displacement means for the application 51*a*, 52*a* or 51*b*, 52*b* extending parallel to the cutting and connection plane P and a mobile portion 54*a* or 54*b*, forming a slider, fastened to the corresponding application support 50*a* or 50*b*, the slide 53*a* or 53*b* being fastened to the drive rod 51*a* or 51*b*, if applicable (see in particular FIG. 7).

Each application support 50*a* or 50*b* can comprise an external application surface against which the piece of adhesive tape 6*a* or 6*b* in question can be applied. In addition, in the case in which the displacement means for the application 51*a*, 52*a*, 51*b*, 52*b* are capable of moving the corresponding application support 50*a*, 50*b* in a single rotation or pivoting movement, the external application surface of each support which is parallel to the cutting and connection plane P in the application position can be inclined, in the waiting position, due to the rotation, with respect to the cutting and connection plane P, and keep this inclination in the preparation position by the above-mentioned translation movement, which makes it possible to facilitate the positioning and the application of the piece of adhesive tape 6*a* or 6*b* in question by the operator outside of the connection assemblies, or to simplify the operation of the cutting and connecting device, in contrast to a system which would keep an orientation of the external application surface parallel to the cutting and connection plane or which would require a change in orientation of said surface between the waiting position in which the latter would be parallel to the cutting and connection plane, and the preparation position.

Moreover, it should be noted that, in the case in which a single piece of adhesive tape 6*a* or 6*b* is applied, it is possible preferably to provide for activating the two opposite application supports 50*a* and 50*b*, one of the application supports 50*a* or 50*b* having the function of supporting the piece of adhesive tape 6*a* or 6*b* and the other application support 50*a* or 50*b* comprising no piece of adhesive tape 6*a* or 6*b* and having the function of forming an application counter-part.

The first immobilization system 7*a* or 7*b*, 8, 10*a* or 10*b*, 10*c* of each assembly can include first downstream immobilization means 7*a*, 7*b* capable of generating a holding pressure, preferably a holding pressure by squeezing, on the downstream portion of the first band 2*a* located downstream of the cutting line and, if applicable, upstream immobilization means 10*a*, 10*b*, 10*c* capable of generating a holding pressure, preferably a holding pressure by squeezing, on the upstream band portion 21*a* of the first band 2*a* located upstream of the cutting line.

In a preferred embodiment, the downstream immobilization means 7*a*, 7*b* can form first downstream immobilization means, and the cutting and connecting device can include, in addition, second downstream immobilization means 8 capable of generating a supplemental holding pressure on the first band 2*a* downstream of said first downstream immobilization means.

The second immobilization system 9*a*, 9*b*, 10*a*, 10*b*, 10*c* can include, on the one hand, downstream immobilization means 9*a*, 9*b* capable of generating a holding pressure, preferably a holding pressure by squeezing, on the downstream band portion 20*b* of the second band 2*b*, preferably at the level of the free end thereof, in order to hold the latter in the preparation position, and, on the other hand, upstream immobilization means 10*a*, 10*b*, 10*c* capable of generating a holding pressure, preferably a holding pressure by squeezing, on the upstream band portion 21*b* of the second band 2*b* located upstream of the cutting line in order to immobilize said second band 2*b* in the cutting and connection plane P and to maintain the cut upstream band portion 21*b* thereof in said plane in view of the connections thereof to the cut downstream band portion 20*a* of the first band 2*a*. If applicable, preferably, said upstream immobilization means of the second band 2*b* can also form the upstream immobilization means of the first band 2*a*.

Figure 8:
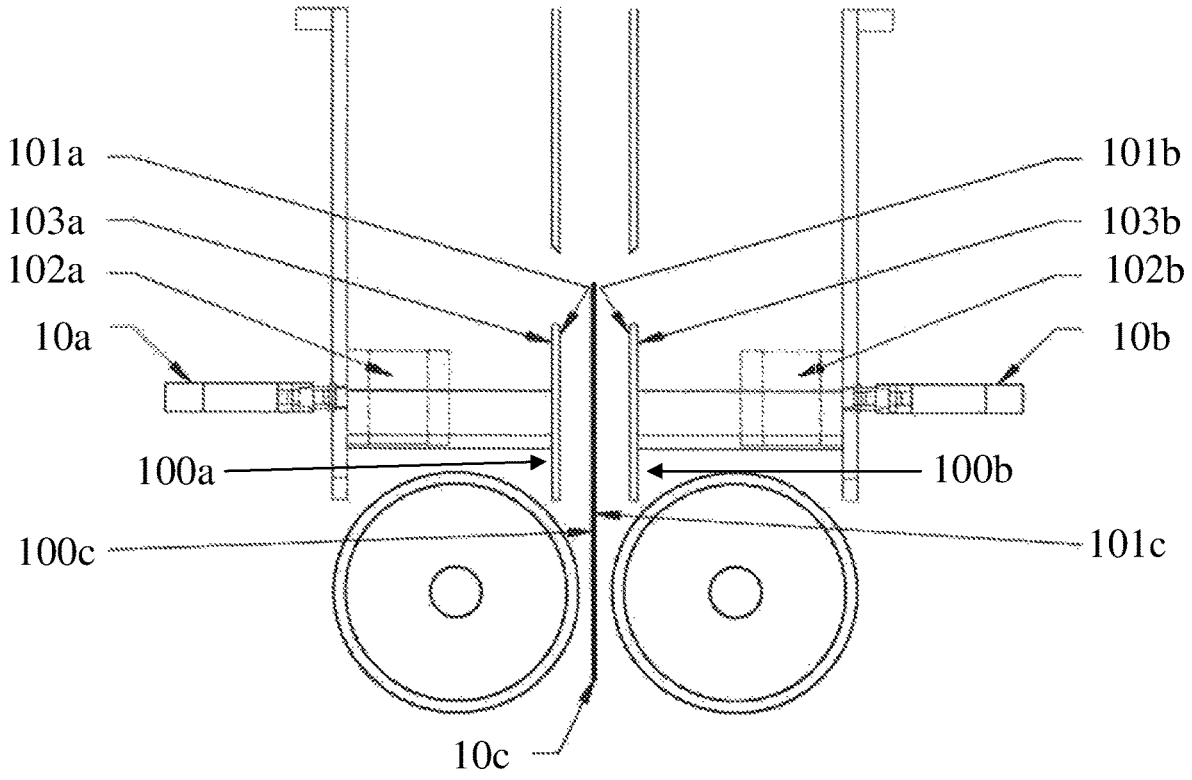
FIG. 8 shows the upstream immobilization means of the second immobilization system of each connection assembly of the cutting and connecting device represented in FIG. 1.

The upstream immobilization means 10*a*, 10*b*, 10*c* of the second immobilization system 9*a*, 9*b*, 10*a*, 10*b*, 10*c* can be capable of generating a holding pressure by squeezing and can include, to this effect, on the one hand, a mobile lateral holding plate 100*a*, 100*b* comprising a lateral holding surface 101*a*, 101*b* parallel to the cutting and connection plane P, and an actuator 102*a*, 102*b* capable of acting on said lateral holding plate in order to move it in translation in a direction perpendicular to said cutting and connection plane P, and, on the other hand, a central holding plate 10*c* common to the two connection assemblies 1*a*, 1*b* and including two opposite central holding surfaces 100*c*, 101*c* arranged each facing one of the lateral holding surfaces 101*a*, 101*b*, respectively, of one of the lateral holding plates 100*a*, 100*b*, so as to be able to generate holding pressures by squeezing, under the action of said holding actuators, on the two opposite surfaces of the second band 2*b*, if applicable, on the two opposite surfaces of the first band 2*a*, running between one of the front holding surfaces 101*a* or 101*b* and one of the central holding surfaces 100*c* or 101*c*, and held squeezed between the latter in order to immobilize it in the corresponding portion thereof (see, in particular, FIG. 8).

Each holding actuator 102*a* or 102*b* can be of the hydraulic or pneumatic jack type and include a rod connected at the free end thereof to the surface 103*a* or 103*b* of the corresponding lateral holding plate 100*a* or 100*b* opposite the lateral holding surface 101*a* or 101*b* thereof.

Each connection assembly can include, in addition, a band curvature straightening system 11*a* or 11*b* including a band curvature straightening element 110*a* or 110*b* comprising a contact surface 111*a* or 111*b*, preferably with a smooth surface, and an actuator 112*a* or 112*b* capable of acting on the latter in order to move it from a rest position into a work position, substantially in the cutting and connection plane P, with the contact surface 111*a* or 111*b* thereof extending, preferably symmetrically, on both sides of the cutting line, in which work position it is capable of coming in contact with pressure on one of the sides of the cut band portions 20*a* and 21*b* to be connected of the first and second bands 2*a* and 2*b*. The side on which the contact surface 111*a* or 111*b* comes in contact is the side opposite the side thereof having a convex portion in the case in which said band portions have a: curved shape, in order to give them the flattest possible shape so as to avoid any subsequent connection problem.

The band curvature straightening element 11*a* or 11*b* can form, in addition, a cutting counter-part and can include for this purpose a slot forming a passage for the cutting device 40.

The cutting device 40 can consist of a blade having a cutting edge extending transversely to the cutting and connection plane P, preferably substantially perpendicularly to the latter. More particularly, the cutting edge will be selected so it has a shape and/or a material suitable for the material to be cut. In other variants, not represented, of the cutting device 40, the latter can consist, for example, of a rotating blade, a Laser beam or a high-pressure jet.

The disengagement system 3*a*, 12*a* or 12*b* can include, on the one hand, downstream disengagement means 12*a* or 12*b* for the cut downstream band portion 20*b* of the second band 2*b* not intended to be connected, said downstream disengagement means 12*a* or 12*b* being capable of disengaging said downstream band portion 20*b* of the second band 2*b* by an effect of bringing about a displacement of the latter in the downstream direction, and, on the other hand, upstream disengagement means 3*a* for the upstream band portion 21*a* of the first band 2*a* not intended to be connected. The upstream disengagement means can consist of the spool 3*a* which is capable of unrolling the cut upstream band portion 21*a* of the first band 2*a* and/or can consist of gravity and/or of blowing and/or of any other means capable of disengaging the cut upstream band portion 21*a* of the first band 2*a* from the connection zone. The downstream disengagement means 12*a* or 12*b* of each downstream disengagement system 12*a* or 12*b* can include a plate for bringing about a displacement 120*a* or 120*b*, preferably a metal sheet, preferably arranged substantially perpendicularly to the cutting and connection plane P, having two opposite sides, namely a downstream side and an upstream side, means for guiding a displacement 123*a*, 123*b*, preferably of a translation or of a pivoting from downstream to upstream, and actuation means 121*a*, 122*a* or 121*b*, 122*b* capable of acting on said plate in order to move it in the downstream direction, preferably with a translation and/or pivoting movement (FIGS. 1, 2, 3, 4, 5, 6).

Such displacement guidance means 123*a* or 123*b* can consist, preferably, of a hinge enabling a pivoting movement (FIGS. 1, 2, 3, 4, 5, 6) or, not represented, of sliding elements enabling the guiding of the plate in translation in the downstream direction or in the upstream direction parallel to the cutting and connection plane P.

Such actuation means 121*a*, 121*b* or 122*a*, 122*b* of the disengagement means 12*a* or 12*b* of each cutting and connection assembly 1*a* or 1*b* can include an actuator 122*a* or 122*b*, for example, of the hydraulic or pneumatic jack type, the rod of which ends with a contact or pressing piece 121*a* or 121*b* that comes in contact on the upstream side of said plate in such a manner as to bring about a pressing in the downstream direction of the latter at the time of the exit of the rod. The contact piece 121*a* or 121*b* does not necessarily need to be attached to the plate for bringing about a displacement 120*a* or 120*b* or hinged to the latter. Indeed, in a vertical orientation of the cutting and connection plane P, the reentry of the rod will naturally, due to the effect of gravity, bring about a downward displacement of the plate toward its rest position. In the case in which the orientation of the cutting and connection plane P is different and cannot benefit from this gravity effect, the present invention can provide for attaching or hinging the rod to said plate or it can provide a return means making it possible to automatically return the plate, under the effect of the return force, to its rest position during the reentry of the rod (FIGS. 1, 2, 3, 4, 5 and 6).

Thus, during operation (FIGS. 4 and 5), and after having turned down or folded, preferably substantially perpendicularly to the cutting and connection plane P, the cut downstream band portion 20*b* of the second band 2*b* on the downstream side of said plate, the movement of the latter in the downstream direction will also result in the movement in the downstream direction of said cut downstream band portion 20*b*, disengaging it from the connection zone.

The unrolling machine according to the present invention includes a cutting and connecting device and two spool carrier elements each capable of supporting a spool 3*a* capable of unrolling a first band 2*a* for ensuring the feeding of the band to the machine or a spool 3*b* capable of unrolling a second band 2*b* forming a replacement band.

According to the present invention, in such a machine, the cutting and connecting device consists of a cutting and connecting device according to the present invention.

Still according to the present invention, such an unrolling machine can include, in addition, a band accumulator located downstream of the cutting and connecting device, and which is capable of being filled with a given length of first band 2*a*, before the stopping and immobilization of the latter in the cutting and connecting device, and of ensuring the continuity of the downstream feed during the connection and the immobilization of the first band 2*a* in said device.

Such a band accumulator, not represented, which covers the connection assemblies, for example, by a bridge structure, or which is located downstream of the latter, will be filled before the stopping and the immobilization of the first band 2*a* upstream of the accumulator, for example, of the type described in the document FR 2 930 534, and makes it possible to ensure the continuity of the feed during the connection which brings the unrolling of the first band 2*a* feeding the machine to a stop.

It should be understood that the method according to the invention, which can be implemented using such a machine according to the present invention, can also be implemented in a conventional machine or a machine according to the present invention that does not comprise a band accumulator.

Each spool carrier can be located on one side or the other of the cutting and connection plane P, as is the case in the appended figures, or on the same side as the other spool carrier, with deflection rollers located on both sides of said plane.

Thus, the cutting and connecting method, the cutting and connecting device, and the machine including the latter have at least the following advantages or have the effect of enabling:

- a better accessibility for the engagement or threading of the second band in step a/,
- a reduced cycle time,
- a compactness of the cutting and connecting device, and of the unrolling machine provided with said device,
- a reduction of the parts constituting the cutting and connecting device and the unrolling machine,
- a better accessibility for maintenance,
- a holding of the first band 2*a* and of the second band 2*b* as close as possible to the cutting line,
- a connection, as desired, with a single piece of adhesive tape applied to one of the opposite sides (or surfaces) of the two bands to be connected or with two pieces of adhesive tape each applied to one of said opposite sides (or surfaces), regardless of the thickness of said piece (s) of adhesive tape or the like thus applied,
- continuity of the feed during the connection and immobilization of the first band 2*a*.

Naturally, the invention is not limited to the described embodiment(s) represented in the appended drawings. Modifications remain possible, notably with regard to the constitution of the various elements or by substitution of technical equivalents, without however leaving the scope of protection of the invention.

The invention claimed is:

1. A method for cutting and connecting first and second bands end to end and which are at a stop in an unrolling machine comprising:

a cutting and connecting device; and two spool carrier elements, one of the spool carrier elements supporting a spool configured for unrolling the first band ensuring feeding of the first band to the unrolling machine and the other spool carrier element supporting a spool configured for unrolling the second band forming a replacement band, each band having two opposite longitudinal edges and two opposite sides, wherein the cutting and connecting device includes two connection assemblies arranged symmetrically with respect to a cutting and connection plane and is configured for simultaneously and transversely cutting the first and second bands in the connection plane in a cutting direction and along a cutting line successively passing through the two longitudinal edges of each band, perpendicularly or at an angle with respect to the latter, each connection assembly including a mobile application support, the method comprising the following steps according to phase A/ and phase B/:

phase A/ during the unrolling of the first band:

a/ engaging the second band between connection assemblies to place and maintain the second band in a preparation position in which the second band extends on both sides upstream and downstream of the cutting line;

b/ placing, outside of the connection assemblies, adhesive on at least one of the mobile application supports shifted to the outside; and c/ immobilizing the second band in the cutting and connection plane;

phase B/ during stopping of the unrolling of the first band at least in a downstream portion thereof:

carrying out step b/ and/or step c/ when step b/ and/or step c/ are not carried out in phase A/;

d/ immobilizing the first band in the connection plane;

e/ simultaneously and transversely cutting the first and second bands in a direction and along the cutting line, which has the effect of separating each band into two band portions, on one hand, a cut downstream band portion located downstream of the cutting line, and, on the other hand, a cut upstream band portion located upstream of the cutting line and connected to the spools of the first and second bands;

f/ maintaining the immobilization, in the connection plane, of the cut upstream band portion of the second band and of the cut downstream band portion of the first bands;

g/ disengaging, by displacement or rolling of the band, the downstream band portion of the second band and the upstream band portion of the first band to free a connection zone including the end of the downstream band portion of the first band and the end of the upstream band portion of the second band to be connected together; and h/ transferring, in the connection zone, the adhesive, simultaneously or successively, by applying the adhesive to one of the sides, or by applying adhesive on each side, of the respective ends of the cut upstream and downstream band portions to be connected in order to carry out a connection of the two bands together using the adhesive to form a new feed band, wherein, in step h/, the adhesive is transferred in the connection zone, after the cutting, in a single translation or rotation movement from a waiting position in time before the cutting, wherein the waiting position is located in a corresponding connection assembly corresponding to a connection position located in the connection zone in the cutting and connection plane.

2. The method according to claim 1, wherein, in step g/, the disengagement of the cut downstream band portion of the second band is carried out by a downstream or lateral movement of the cut downstream band portion.

3. The method according to claim 1, wherein, in step g/, the disengagement of the cut upstream band portion of the first band is carried out by at least one of rolling, gravity, and blowing of the latter around the spool thereof.

4. A method for cutting and connecting first and second bands end to end and which are at a stop in an unrolling machine comprising:

a cutting and connecting device; and two spool carrier elements, one of the spool carrier elements supporting a spool configured for unrolling the first band ensuring feeding of the first band to the unrolling machine and the other spool carrier element supporting a spool configured for unrolling the second band forming a replacement band, each band having two opposite longitudinal edges and two opposite sides, wherein the cutting and connecting device includes two connection assemblies arranged symmetrically with respect to a cutting and connection plane and is configured for simultaneously and transversely cutting the two bands in the connection plane in a cutting direction and along a cutting line successively passing through the two longitudinal edges of each band, perpendicularly or at an angle with respect to the latter, each connection assembly including a mobile application support, and a straightening contact element, the method comprising the following steps according to phase A/ and phase B/:

phase A/ during the unrolling of the first band:

a/ engaging the second band between connection assemblies in order to place and maintain the second band in a preparation position in which the second band extends on both sides upstream and downstream of the cutting line;

b/ placing, outside of the connection assemblies, adhesive on at least one of the mobile application supports shifted to the outside; and c/ immobilizing the second band in the cutting and connection plane;

phase B/ during stopping of the unrolling of the first band at least in a downstream portion thereof:

carrying out step b/ and/or step c/ when step b/ and/or step c/ are not carried out in phase A/;

d/ immobilizing the first band in the connection plane;

e/ simultaneously and transversely cutting the first and second bands in a direction and along the cutting line, which has the effect of separating each band into two band portions, on one hand, a cut downstream band portion located downstream of the cutting line, and, on the other hand, a cut upstream band portion located upstream of the cutting line and connected to the spools of the first and second bands;

f/ maintaining the immobilization, in the connection plane, of the cut upstream band portion of the second band and of the cut downstream band portion of the first band;

g/ disengaging, by displacement or rolling of the band, the downstream band portion of the second band and the upstream band portion of the first band in order to free a connection zone including the end of the downstream band portion of the first band and the end of the upstream band portion of the second band to be connected together; and h/ transferring, in the connection zone, the adhesive, simultaneously or successively, by applying the adhesive to one of the sides, or by applying adhesive on each side, of the respective ends of the cut upstream and downstream band portions to be connected in order to carry out a connection of the two bands together using the adhesive, in order to form a new feed band, wherein, in step h/ and when the first band and/or the second band are curved with one of the opposite sides thereof having a curvature, the method further comprises successively transferring, in the connection zone, the adhesive along an orientation of convexity of the curvature, the adhesive supported by the mobile application support located on a side of the convex curvature, and in straightening the curvature of the first band and/or of the second band, to make the latter as flat as possible by coming in contact with pressure on the opposite side of the cut band portions of the first and second bands to be connected, by an other opposite straightening contact element, then, optionally, in a second step, to be connected by additional adhesive in order to finalize the connection.

5. A device for cutting and connecting first and second bands end to end and which are at a stop, for an unrolling machine, the device comprising:

a cutting and connecting device including two connection assemblies arranged symmetrically with respect to a cutting and connection plane; and two spool carrier elements, each configured for supporting a spool configured for unrolling the first band ensuring feeding of the first band to the unrolling machine, or the second band forming a replacement band, each band having two opposite longitudinal edges and two opposite sides, wherein the cutting and connecting device includes a transverse cutting system including a cutting device configured to displace the cutting device in a cutting direction and along a transverse cutting line, substantially perpendicular or at an angle with respect to the longitudinal edges, having an effect of simultaneously cutting the first and second bands, kept in an immobilized state in the connection plane, by successively through the respective longitudinal edges thereof, wherein each connection assembly, dedicated to either of the first and second bands, includes an adhesive applicator including an application support configured for holding a piece of adhesive tape, and configured for displacing the corresponding application support from a waiting position in time before the cutting, wherein the waiting position is located in the corresponding connection assembly to a position of application of the piece of adhesive tape, located in the connection plane, and vice versa, a first immobilizer configured for immobilizing the first band in the connection plane, and a second immobilizer configured for maintaining the second band in a preparation position and immobilizing the latter in the connection plane, and a disengagement system configured to disengage, after the cutting, by displacement or rolling up of the band, cut band portions not intended to be connected, to enable the application of one or two piece(s) of adhesive tape by movement of the two opposite application supports, and wherein displacement, after the cutting, includes displacing the corresponding application support in a single translation or rotation movement, from the waiting position thereof toward the application position thereof.

6. The device according to claim 5, wherein each adhesive applicator is configured for displacing the corresponding application support from a preparation position located outside of the cutting and connecting device and configured to receive a piece of adhesive tape into the waiting position located in the corresponding connection assembly, and vice versa.

7. The device according to claim 6, wherein the device is configured for displacing the corresponding application support in a translation movement parallel to the cutting and connection plane, and wherein the displacement for the preparation consists of a sliding system including a slide fastened to the displacement for the application, extending parallel to the cutting and connection plane, and a mobile portion forming a slider, fastened to the corresponding application support, the slide being fastened to a drive rod.

8. The device according to claim 5, wherein the first immobilizer of each assembly includes a first downstream immobilizer configured for generating a holding pressure, on a downstream portion of the first band located downstream of the cutting line, and, an upstream immobilizer configured for generating a holding pressure, on an upstream portion of the first band located upstream of the cutting line.

9. The device according to claim 8, wherein the first immobilizer further includes a second downstream immobilizer configured for generating a supplemental holding pressure on the first band downstream of the first downstream immobilizer.

10. The device according to claim 5, wherein the second immobilizer includes, on one hand, a downstream immobilizer configured for generating a holding pressure, on a downstream band portion of the second band, at a free end thereof, in order to maintain the latter in the preparation position, and, on the other hand, upstream immobilizer configured for generating a holding pressure, on an upstream band portion of the second band located upstream of the cutting line to immobilize the second band in the cutting and connection plane and to maintain the cut upstream band portion thereof in the connection plane, the upstream immobilizer for the second band also forming the upstream immobilizer for the first band.

11. The device according to claim 10, wherein the upstream immobilizer of the second immobilizer is configured for generating a holding pressure by squeezing, and includes, on one hand, a mobile lateral holding plate comprising a lateral holding surface parallel to the cutting and connection plane and an actuator configured for acting on the lateral holding plate to displace it in translation in a direction perpendicular to the cutting and connection plane, and, on the other hand, a central holding plate common to the two connection assembles and including two opposite central holding surfaces, each arranged facing one of the lateral holding surfaces of one of the lateral holding plates, respectively.

12. The cutting and connecting device according to claim 5, wherein each connection assembly includes a band curvature straightening system including a band curvature straightening element comprising a contact surface, and an actuator configured for acting on the latter so as to displace the latter from a rest position to a work position, substantially in the cutting and connection plane, with the contact surface thereof extending, symmetrically, on both sides of the cutting line, in which the latter is configured for coming in contact with pressure on one of the sides of the cut portions to be connected with the first and second band.

13. The device according to claim 12, wherein the band curvature straightening element forms a cutting counterpart, and includes a slot forming a passage for the cutting device.

14. The device according to claim 5, wherein the cutting device consists of a blade having a cutting edge extending transversely to the cutting and connection plane, perpendicularly to the latter.

15. The device according to claim 5, wherein the disengagement system includes, on one hand, a downstream disengager for the cut downstream band portion of the second band not intended to be connected, the downstream disengager being configured for disengaging the downstream band portion of the second band by bringing about a displacement of the latter in a downstream direction, and, on the other hand, upstream disengager for the upstream band portion of the first band not intended to be connected, the upstream disengager consisting of the spool which is configured for unrolling the cut upstream band portion of the first band and disengaging the upstream band portion of the first band from a connection zone.

16. The device according to claim 15, wherein the downstream disengager of each disengagement system include a plate for bringing about displacement, oriented substantially perpendicularly to the cutting and connection plane, having two opposite sides, a downstream side and an upstream side, a guide for guiding of a displacement of a translation or of a pivoting from upstream to downstream and vice versa, and an actuator configured for acting on the plate to displace it downstream, with a translation and/or pivoting movement.

17. An unrolling machine comprising a cutting and connecting device according to claim 5, and two spool carrier elements each configured for supporting a spool configured for unrolling a first band ensuring the feeding of the band to the unrolling machine or a spool configured for unrolling a second band forming a replacement band, wherein the unrolling machine is configured for being filled with a given length of first band, before a stopping and immobilization of the latter in the cutting and connecting device, and of ensuring continuity of a downstream feed during the connection and the immobilization of the first band in the device.

18. A device for cutting and connecting first and second bands end to end and which are at a stop, for an unrolling machine, device comprising:

a cutting and connecting device including two connection assemblies arranged symmetrically with respect to a cutting and connection plane; and two spool carrier elements, each configured for supporting a spool configured for unrolling the first band ensuring the feeding of the first band to the unrolling machine, or the second band forming a replacement band, wherein the cutting and connecting device includes a transverse cutting system including a cutting device and configured to displace the cutting device in a cutting direction and along a transverse cutting line, substantially perpendicular or at an angle with respect to longitudinal edges, having an effect of simultaneously cutting the first and second bands kept in an immobilized state in the connection plane, by successively through the respective longitudinal edges thereof, and wherein each connection assembly, dedicated to either of the first and second bands, includes an adhesive applicator including an application support configured for holding a piece of adhesive tape, and configured for displacing the corresponding application support from a waiting position located in the corresponding connection assembly to a position of application of the piece of adhesive tape, located in the connection plane, and vice versa, a first immobilizer configured for immobilizing the first band in the connection plane, and a second immobilizer-configured for maintaining the second band in a preparation position and immobilizing the latter in the connection plane, and a disengagement configured to disengage, after the cutting, by displacement or rolling up of the first and second bands, the cut band portions not intended to be connected, in order to enable, as desired, the application of one or two piece (s) of adhesive tape by movement of the two opposite application supports, wherein the device is configured for displacing the corresponding application support in a single rotation movement, and wherein the displacement for the application consists of a lever system including, on one hand, a drive rod to which the corresponding application support is fastened, which is configured for pivoting around a first pivot parallel to the cutting and connection plane, and, on the other hand, an actuator configured for acting on a connecting rod to bring about the pivoting thereof, the actuator consisting of a jack comprising a rod hinged at the end thereof to the connecting rod around a second pivot, while a body of the jack is pivotably mounted around a third pivot parallel to the first and second pivots.

* * * * *